US006457605B2

(12) United States Patent
Coleman

(10) Patent No.: US 6,457,605 B2
(45) Date of Patent: Oct. 1, 2002

(54) PAPER NAPKIN DISPENSER

(76) Inventor: Eugene R. Coleman, 49 S. Bayshore Dr., Bowers Beach, DE (US) 19946

( * ) Notice: Subject to any disclaimer, the term of this patent is extended or adjusted under 35 U.S.C. 154(b) by 0 days.

(21) Appl. No.: 09/771,997

(22) Filed: Jan. 30, 2001

Related U.S. Application Data

(60) Provisional application No. 60/181,082, filed on Feb. 8, 2000.

(51) Int. Cl.[7] ..... A01C 9/00

(52) U.S. Cl. ..... 221/213; 221/259

(58) Field of Search ..... 221/213, 210, 221/259, 277, 42, 43, 33, 56, 58, 253, 226, 231, 237, 217

(56) References Cited

U.S. PATENT DOCUMENTS

| | | | | |
|---|---|---|---|---|
| 1,324,415 A | | 12/1919 | Smith | |
| 1,599,175 A | | 9/1926 | Hellstrom | |
| 1,703,594 A | * | 2/1929 | Pratt | 221/43 |
| 1,752,885 A | | 4/1930 | Carroll | |
| 2,080,691 A | | 5/1937 | Broeren | |
| 2,382,959 A | | 8/1945 | Cameron | |
| 4,181,218 A | | 1/1980 | Cox | |
| 4,662,536 A | | 5/1987 | Powers | |
| 5,505,334 A | | 4/1996 | Triglia | |

FOREIGN PATENT DOCUMENTS

| | | |
|---|---|---|
| FR | 455914 | 12/1950 |

* cited by examiner

*Primary Examiner*—Kenneth W. Noland
(74) *Attorney, Agent, or Firm*—Richard C. Litman

(57) ABSTRACT

A napkin dispenser is provided which dispenses napkins, one at a time. The casing or housing of the napkin dispenser sits on a rotatable support platform. The dispenser assembly principally includes a roller and a follower. The roller engages and respectively ejects a napkin from a weighted napkin stack via the follower which urges napkins into engagement with the roller. The roller has a plurality of metal protrusions peripherally attached on its exterior surface for penetrably engaging with the material substrate of each respective napkin which enables reliable and efficient delivery of individual napkins for dispensing.

17 Claims, 9 Drawing Sheets

PAPER NAPKIN DISPENSER

CROSS-REFERENCE TO RELATED APPLICATION

This application claims the benefit of U.S. Provisional Patent Application Serial No. 60/181,082, filed Feb. 8, 2000.

BACKGROUND OF THE INVENTION

1. Field of the Invention

The present invention relates generally to dispensers. More specifically, the invention is an apparatus for dispensing paper napkins and peripherally retaining a variety of condiments.

2. Description of Related Art

Numerous apparatuses have been devised for storing and dispensing thin, sheet-like articles such as napkins. Some of the most significant advances in the art have centered around the development of devices which dispense one article at a time. Most of the conventional techniques described below use mechanical devices or frictional means for separating and dispensing stacked planar articles; however, none of the references describes a device designed to penetrably engage and displace the leading napkin of a napkin stack, for repeatable and reliable delivery of a single napkin with each occasion of use. For example, U.S. Pat. No. 1,752,885, issued to Carroll, presents a dispensing device which includes a casing formed with a dispensing slot, a guide wall within the casing which communicates with the slot, and inclined trackways within the casing. A follower is movably suspended from the trackways, and a roller is located beneath the guide wall. The follower is used for urging a stack of papers against the guide wall and roller, for dispensing papers from the device. The roller is positioned beneath the wall in order to cause a bend in the stack and has a frictional means adapted to agitate the stack of papers during rotation of the roller, thereby displacing the papers through the exit slot.

U.S. Pat. No. 2,080,691, issued to Broeren, discusses a napkin dispenser comprising a container for a stack of napkins folded to stand on their lower edges and arranged to present a free grasping tab. The container includes a front hinged panel having a dispensing opening and cooperating side panels, the panels having inwardly depressed portions for contacting the side edges of the stack of napkins to guide them as they are fed forwardly in aligned position with relation to the dispensing opening. Also included are means for engaging the upper portion of the foremost napkin in the stack and a flange affixed to the lower portion of the front hinged panel and extending inwardly within the container for engaging the lower portions of the foremost napkin of the stack. Upper and lower napkin engaging means permit successive single withdrawals of the foremost napkin in the stack. These same means retain the next succeeding napkins within the container in dispensing position, relieving the localized pressure of the stack on the foremost napkin at its upper and lower portions as it is being withdrawn from the container.

U.S. Pat. No. 2,382,959, issued to Cameron, discloses a newspaper vending machine comprising a casing having front and side walls and a forwardly and downwardly sloping bottom member adapted to support a plurality of folded newspapers in vertical position with folded edge lowermost. Fixed means are located at the forward edge of the bottom member to provide a stop for the foremost newspaper on the bottom member and are positioned to provide a support for a newspaper when advanced upwardly and forwardly of the stop. At the forward edge of the fixed means is located a horizontal newspaper delivery slot having a closure member. A vertically and horizontally movable ejector means is engageable with the bottom of the foremost newspaper on the bottom member. Operative means are provided to guide the ejector means as it moves upwardly to release the newspaper from the stop, then forwardly to advance the newspaper, then downwardly to deposit the newspaper on the fixed means, and then rearwardly and upwardly.

U.S. Pat. No. 4,181,218, issued to Cox, discusses a pre-moistened tissue dispensing container, comprising a base and a cap which are snap fitted together. In this invention the cap is rotatable on the base to an open position in which corresponding apertures in the cap and base side wall are brought into alignment so that a tissue can be extracted. Alternatively, the cap may be rotated to a closed position in which the apertures are not aligned. The side walls of the container provide the respective apertures in frusto-conical wall portions which are urged into contact by inter-engaging elements on the cap and base, permitting relative rotation but opposing relative displacement in the axial direction, at least in the closed position.

U.S. Pat. No. 4,662,536, issued to Powers, presents a paper filter dispenser, comprising a band that passes in contact with a friction wheel. The band has relatively low frictional characteristics downstream from the wheel and where it contacts the wheel. The band has relatively high friction characteristics upstream of the wheel where a stack of filters may be stowed to dispense a filter, a hand crank attached to the wheel is rotated whereupon the innermost member of the stack is urged off of the stack and between an area of substantially tangential contact between the band and wheel and then out of the dispenser.

U.S. Pat. No. 5,505,334, issued to Triglia, discloses a trash container liner dispensing system comprising a storage rod for temporarily supporting container liners. The storage rod is mounted at one end of the rod to the bottom side of a wall having a slot for passing the liners through the wall from the bottom side to the top side of the wall. The attachment of the rod to the wall supports allows the other end of the rod to be free and unsupported as to permit the liners to be slid thereon. A handle is at one end of the slot and generally normal to the slot to avoid uncontrolled twisting of an operator's fingers when handling the assembly.

U.S. Pat. No. 1,599,175, issued to Hellstrom, discloses a paper dispensing cabinet comprising a casing adapted to be housed in a recess in a vertical surface, a front wall for the casing hinged at the lower front corner of the casing, and a vertical slot located substantially centrally of the front wall. Means to limit the outward movement of the front are also provided, as well as downwardly and forwardly sloping slots, the central point of the sloping slots being adjacent to the center of the height of the casing. A gravity actuated weight is included for traveling along the sloping slots to press paper against the front of the casing, and means are incorporated within the casing to draw the weight to the upper end of the sloping slots when the casing is open.

U.S. Pat. No. 1,324,415, issued to Smith, discloses a vending machine comprising a casing having a slot at its front wall, an inclined platform adapted to support articles, an inclined feed member on the platform, guiding means for the upper edge of the feed member, and a delivery member adapted to be raised and lowered at the front edge of the platform to cause articles to be removed therefrom and discharged through the slot of the casing. Also included are means comprising a shaft adapted for raising and lowering the delivery member, and a weighted cable having a suspended weight at the rear side of the feed member and connected to the shaft, the actuation of which causes movement of the feed member to dispense articles. And lastly, the Italian Pat. (IT 455,914), granted to Cesare Calegari, illustrates a device for dispensing thin planar sheets utilizing a roller.

None of the above inventions and patents, taken either singly or in combination, is seen to describe the instant invention as claimed.

SUMMARY OF THE INVENTION

The napkin dispenser according to the invention provides an efficient mechanisms by which napkins may be dispensed, one at a time. The casing or housing of the napkin dispenser sits on a rotatable support platform. The top surface of the platform has hollows for receiving the bottom portions of receptacles for storing various condiments, such as salt and pepper. The housing includes side walls and front and rear walls, the side and rear walls being disposed in perpendicular relationship to the support platform.

The dispenser assembly principally comprises a roller and a follower, the roller for engaging and ejecting the napkins, and the follower for urging napkins into engagement with the roller. The roller is suspended between the side walls and held therebetween by pin means, fixedly located on either end of the roller, the free ends of the pins being disposed through apertures located on the side walls. The follower, a generally rectangular-shaped member, is interposed between the side walls and movably held therebetween. Each side walls is provided with an elongated traveling groove to allow the follower to move there along. The follower is sufficiently weighted to press the napkins into engagement with the roller, but not so heavy as to cause the napkins to be stuck together when dispensed. Furthermore, the follower may be moved into a resting position allowing for easy restocking of napkins.

The roller has a plurality of metal projections or protrusions disposed on its exterior surface for engaging with the cellulose material substrate of the napkins. The use of spaced-apart protrusions for the purpose of penetrating and removing one napkin at a time has been found to be superior to other frictional means. The dispenser may also have storage areas for eating utensils and condiments.

Accordingly, it is a principal object of the invention to provide a napkin dispenser that repeatedly and reliably dispenses one napkin at a time.

It is another object of the invention to provide a napkin dispenser which has may be easily restocked with napkins.

It is a further object of the invention to provide a napkin dispenser which sits on a rotatable support platform.

Still another object of the invention is to provide a napkin dispenser which has accessory areas for storing condiments and utensils.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an apparatus for dispensing napkins. The preferred embodiments of the invention are depicted in FIGS. 1–8 and are generally referenced by numerals 10, 11 and 13, respectively.

Figure 1:
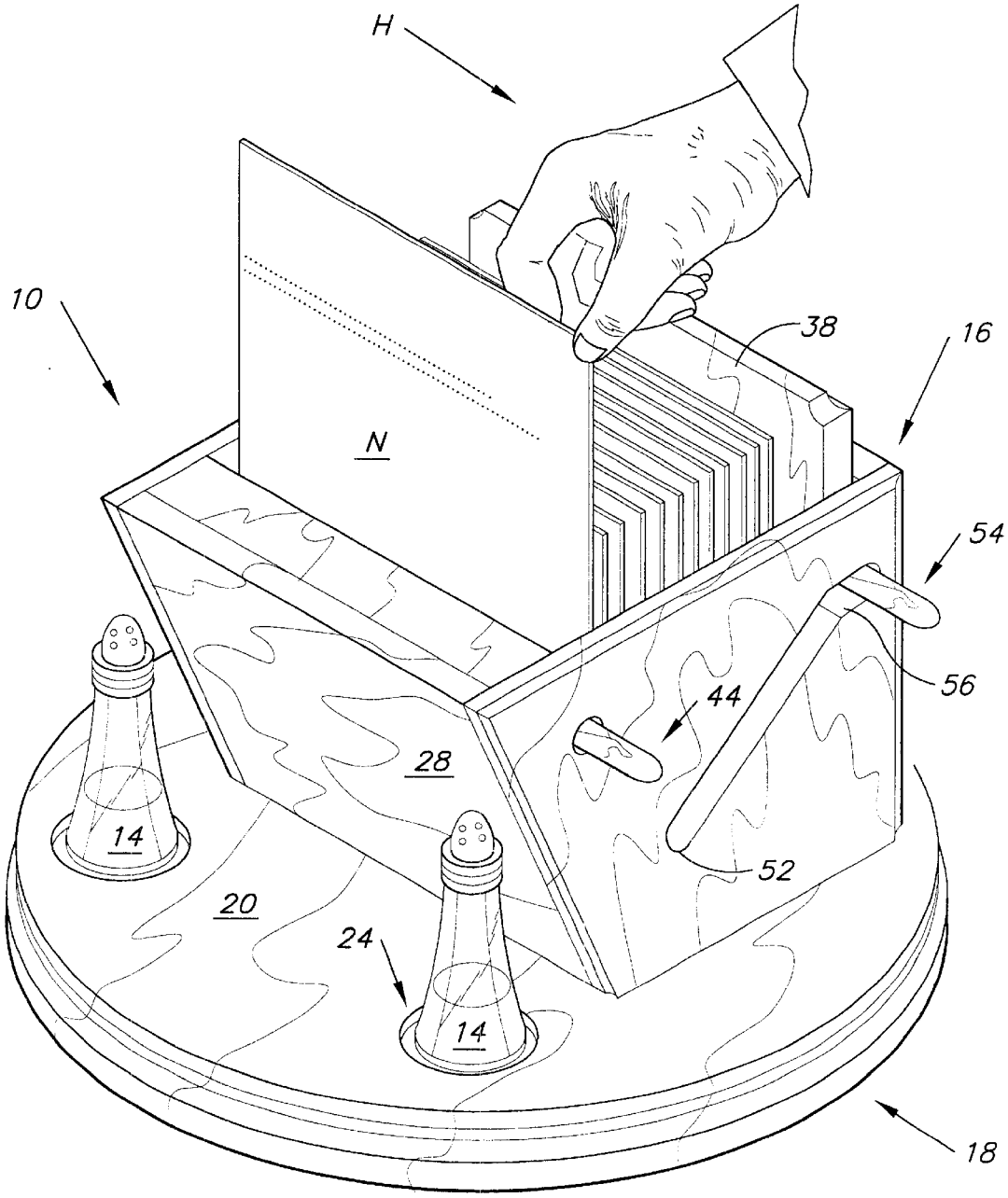
FIG. 1 is an environmental, perspective view of a paper napkin dispenser according to the present invention.

As diagrammatically illustrated in FIG. 1, an environmental view of the napkin dispenser 10 is depicted in which a user's hand H is shown taking a napkin 9, which has been dispensed by turning the roller pin 44, which functions as a handle of the dispenser 10. Along with the napkin dispenser 10 are depicted salt and pepper shakers, generally 14, such as might be found in a typical restaurant, diner, or in a private home for domestic use.

The napkin dispenser 10 provides an efficient means by which napkins 9 may be dispensed, precisely one at a time. Many persons have had the experience of reaching for a napkin and finding that, instead of the single napkin 9 they wished for, a wad of napkins 9 is obtained. Napkins play an important part in the eating habits of the nation. In fact, the general overuse of napkins, has created a serious enough situation for many food establishments across the country that napkins are now commonly rationed out to customers. Excessive use of paper can also result in significant environmental and economic consequences.

Anyone who frequently eats out has experienced the frustration of having to ask food workers for another napkin. This creates an image problem for the restaurant in patron's minds. If a simple, elegant device could be invented to address this situation, an important contribution to the art would be made. For businesses which deal directly with the public, image is everything. Napkin dispensers, along with classic mustard and ketchup bottles and checkered table cloths, provide a homey, retro feel that can significantly contribute to the success of a restaurant. This has become especially true since the recent resurgence of classic old-fashioned diners and the new wave of American style cooking.

Accordingly, the present invention addresses the longfelt need for providing a napkin dispenser 10 that quickly delivers one napkin at a time, making both customer and restaurant owner happy. An additional benefit is that the dispenser 10 allows the napkins themselves to be partially visualized when in resting, stacked formation in the main housing, generally 16, or body of the dispenser 10. Being able to see the napkins in the dispenser 10 provides an important practical and psychological advantage, as it enables the user to appreciate the neatness, cleanliness, and elegance of the invention and the color and decorative qualities of the napkins. This feature also facilitates early detection of when the supply of napkins is low and needs replenishing.

As observed in FIG. 1, The casing or housing 16 of the napkin dispenser 10 sits on a rotatable support platform, 18, having top 20 and bottom 22 (see FIG. 6) surfaces. In the preferred embodiment of the invention, the top surface 20 of the platform 18 has two hollows or depressions, generally 24, disposed thereon for receiving the bottom portions of receptacles 14 for storing condiments. These planar depressions 24 are disposed in spaced-apart relationship on the top surface 20 of the support platform 18. The depressions 24 may be machine cut or otherwise formed into the top surface 20 by any means commonly known in the art. Salt and pepper shakers 14 provide a marketing, decorative, and functional advantage to the invention. The platform 18 may also comprise any shape or size.

It should be understood that this specification embraces any and all conventional storage means for items commonly found in the domestic kitchen, such as knives, spoons, forks, salt cellars, pepper mills, sauce bowls, toothpicks, cooking implements, and spice receptacles. And so, in alternative embodiments of the invention, the top surface 20 of the platform 18 may be provided with depressions, apertures, or support elements of various kinds and numbers for holding, bracing, or otherwise containing conventional household accouterments.

Figure 2:
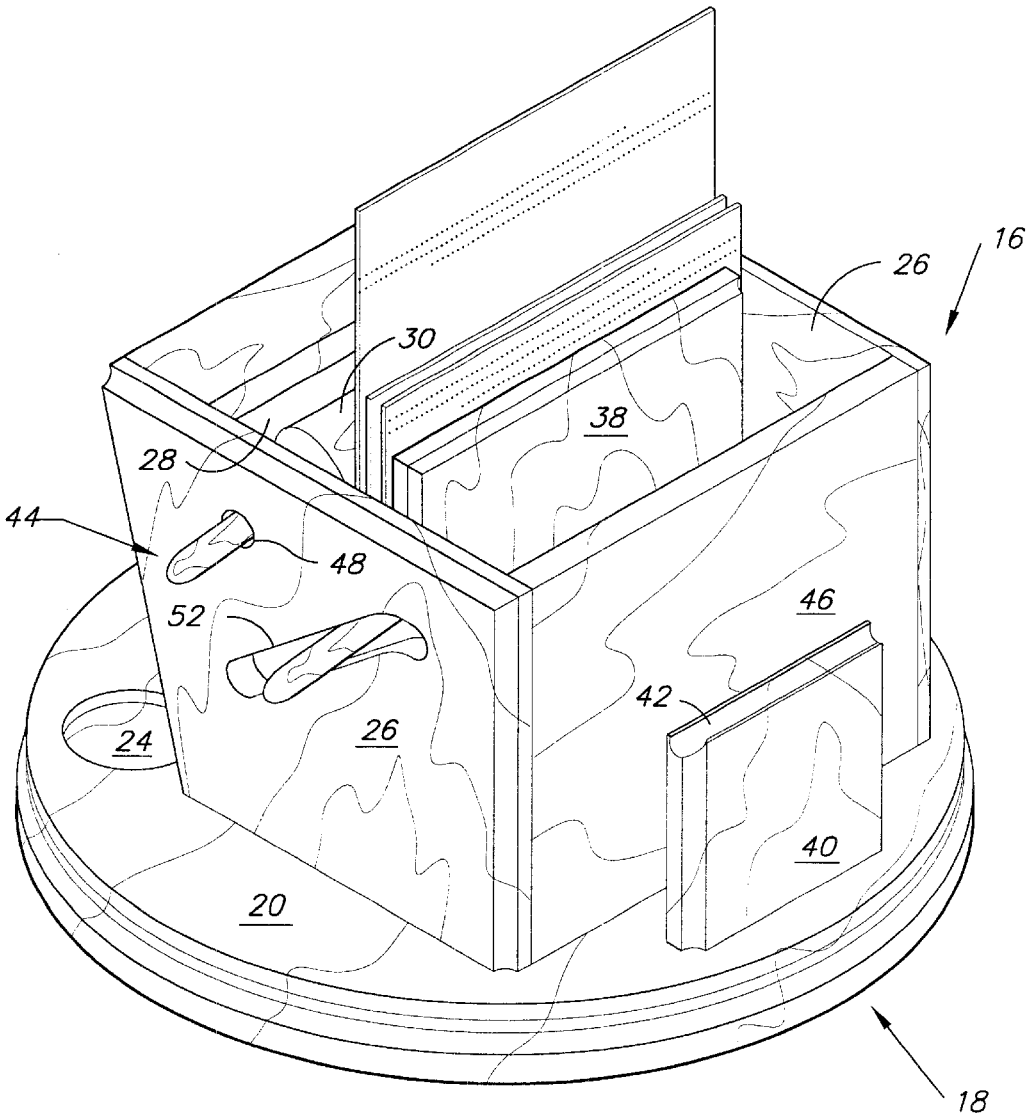
FIG. 2 is a side angle view of the napkin dispenser, according to the invention.

Turning now to FIG. 2, it can be appreciated that disposed on the top surface 20 of the support platform 18 of the present invention is a housing 16 for containing the various working parts of the dispenser 10; the housing 16 includes side walls, generally 26, and front 28 (partial view) and rear 46 walls, the side 26 and rear 30 walls being disposed in perpendicular relationship to the support platform.

Figure 3A:
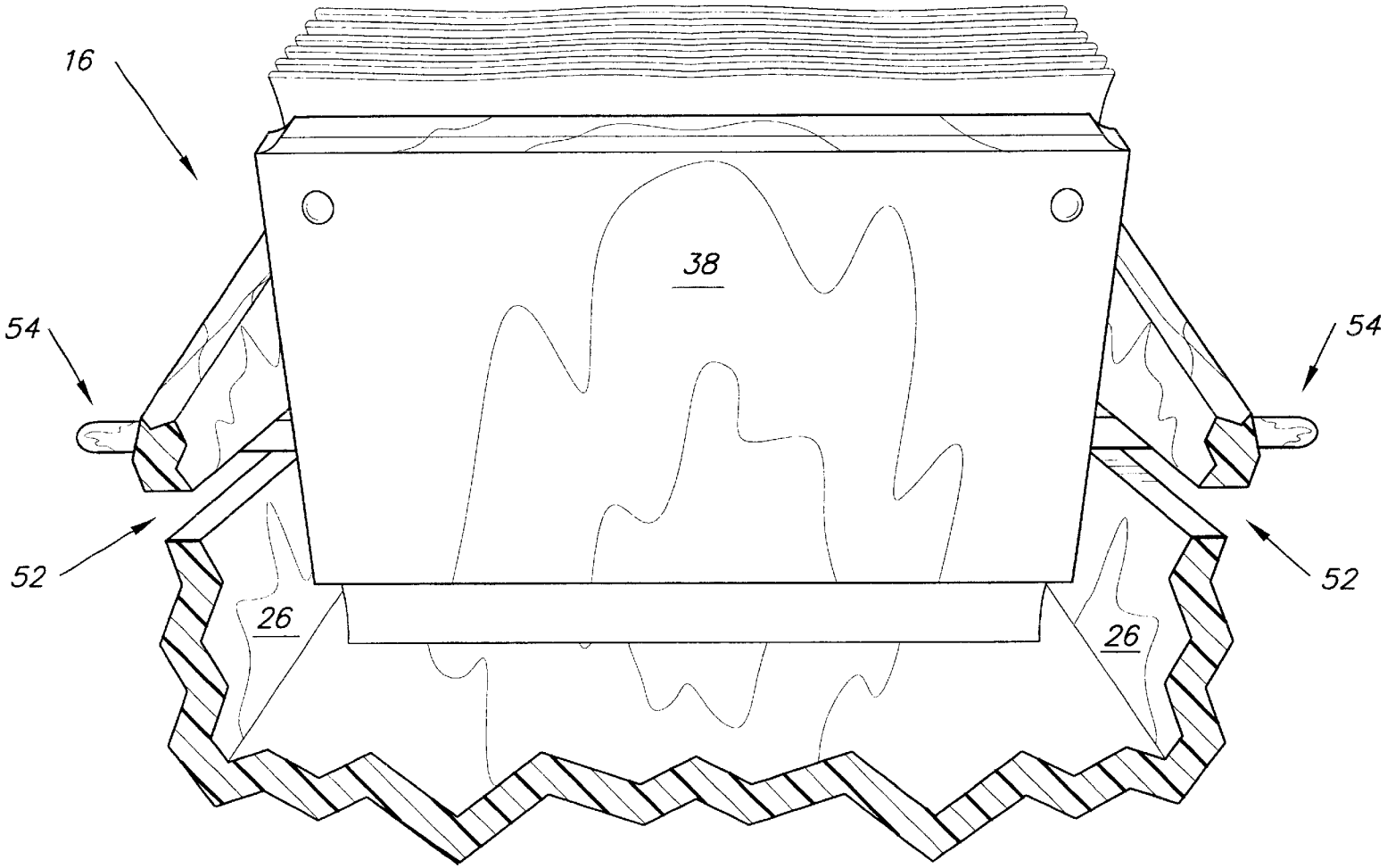
FIG. 3A is a cross-sectional view of the paper napkin dispenser according to the invention, illustrating a section of the rear wall and follower of the dispenser.
Figure 3B:
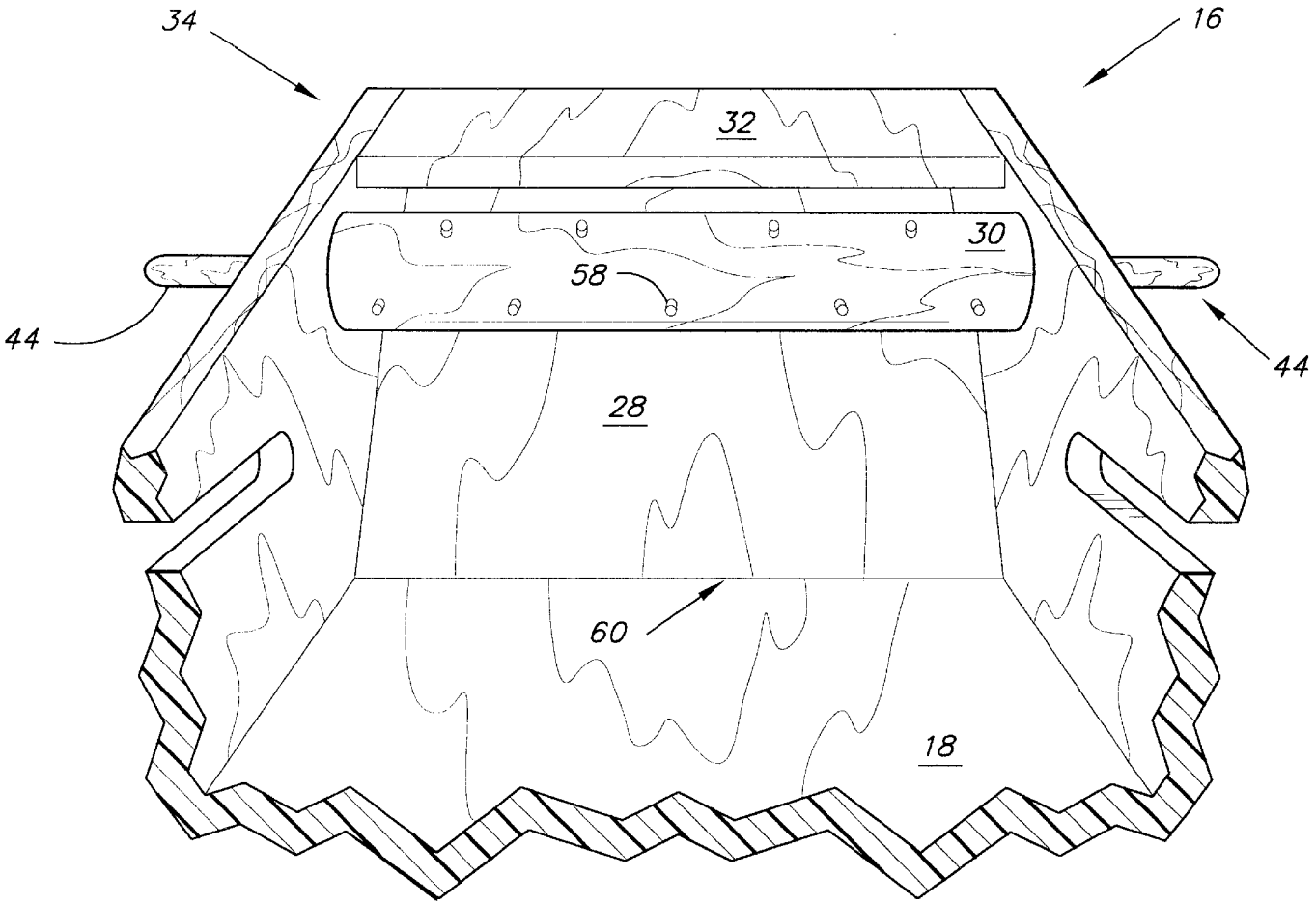
FIG. 3B is a cross-sectional view of the paper napkin dispenser, illustrating the napkin roller with protrusion according to the invention.

Turning now to the cutaway view of FIG. 3B showing the front portion 34 of the dispenser 10, the front wall 28 is arranged so as to vertically diverge from the plane defined by the rear wall (shown removed), the front wall 28 sloping upwardly and forwardly. In the preferred embodiment of the invention, the forward sloping of the front wall 28 has an secondary functional utility. In addition to the obvious decorative benefits when viewed from the front, as in FIG. 1, added space is provided for that part of the dispenser assembly, namely the roller 30, located at the top portion of the housing 16. Additionally, the lower portion of the front wall 28 serves to help keep the napkins sufficiently pressed together—so that when dispensed, the napkins are pleasingly flat and unwrinkled. This particular aspect of the dispenser's 10 construction provides an advance over the prior art as further explained below. A substantially planar shelf, numbered 32, has several functions including being a partial cover for the roller 30, a housing 16 construction brace, and a decorative element.

Figure 4:
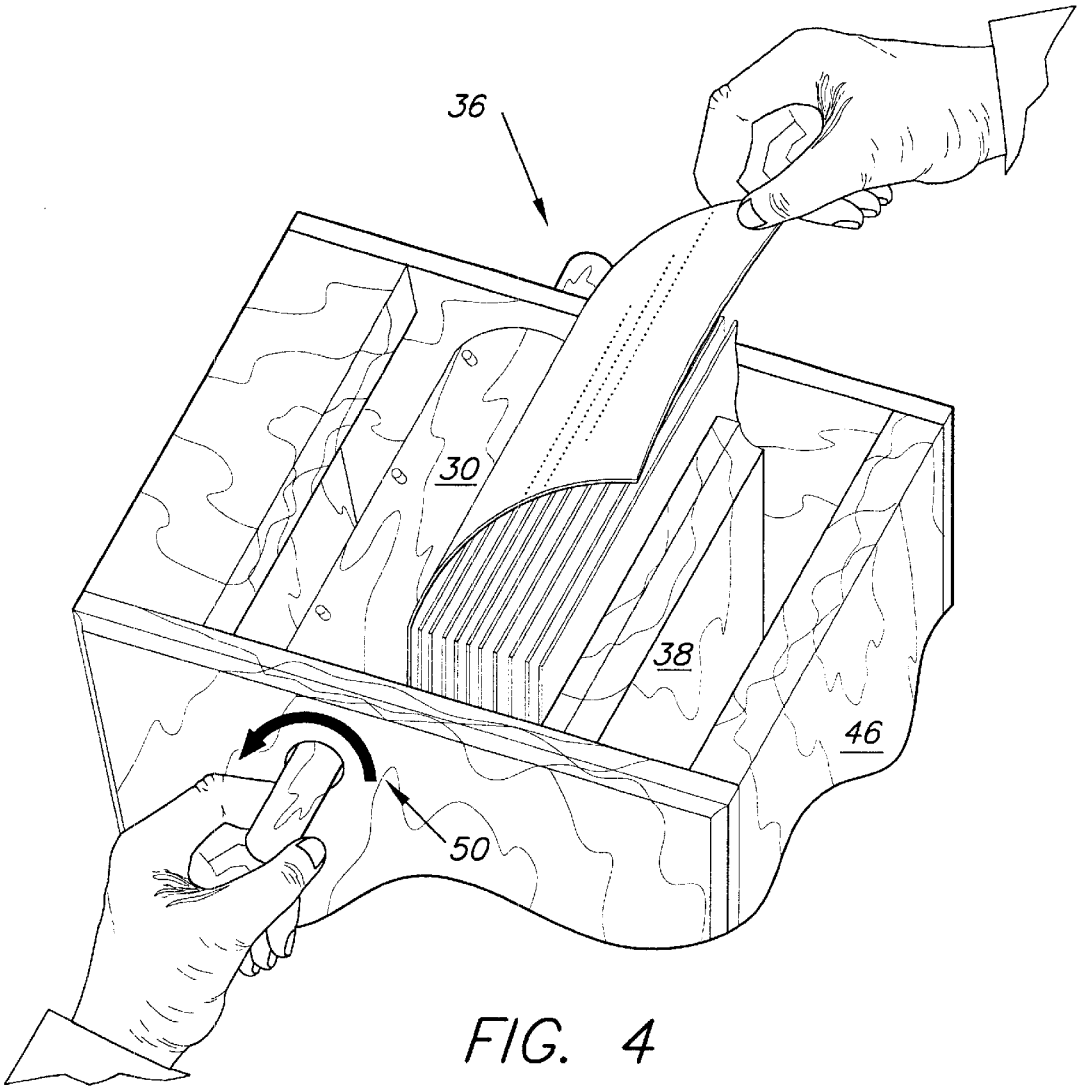
FIG. 4 is a side angle view of the napkin dispenser, according to the invention, illustrating the manner by which a napkin is dispensed.

As can be seen in FIG. 4, the dispenser assembly 36, principally comprises a roller 30 and a follower 38, the roller 30 for engaging and ejecting the napkins, and the follower 38 for urging napkins into engagement with the roller 30.

Referring again to FIG. 2, a supplemental planar storage support plate 40, perpendicular to the platform 18 and generally parallel to the plane defined by the rear wall 46 is also seen; the plate 40 may be used as a supplemental napkin holder, to hold notes or note pads, or for any other purpose the user may find suitable. The groove 42 on the superior surface of the support plate 40 may be used to hold a pen or pencil.

In FIGS. 2 and 3B, it can be clearly seen that the roller 30 is suspended between the side walls 26 and held therebetween by roller pin means, generally 44, fixedly located on either end of the roller 30, the free ends of the roller pins 44 being disposed through apertures 48 located on the side walls 26. In the preferred embodiment of the invention, the roller 30 is symmetrical about the central axis defined by the two oppositely disposed roller pins 44. The roller pins 44 are conveniently used to manually turn the roller 30, substantially as shown in FIG. 4, in the direction of the arrow 50, to dispense a single, crisp napkin.

Referring now to FIG. 3A, one may observe the follower 38, a generally rectangular-shaped member, having a thickness, interposed between the side walls 26 and movably held therebetween. The side walls 26 are each provided with an elongated traveling groove, generally 52, to allow the follower 38 to move downwardly and forwardly, the grooves 52 being dimensioned to receive and support the follower pins 54. One end of each follower pin 54 is fixedly attached to the follower 38, while the free end is disposed through its corresponding groove 54. The grooves 52 each comprise a pin resting notch 56—a substantially horizontal, level portion at their rearward extent for supporting the follower 38 in a stable resting position (see FIG. 1) to allow for easy loading of the napkin dispenser with new napkins. Subsequently, the follower 38 may be engaged as shown in FIG. 1, in which the follower is free to slide down the inclined portion of the grooves 52. In the preferred embodiment, the follower 38 is sufficiently weighted to press the napkins into engagement with the roller 30, but not so heavy as to cause the napkins to be stuck together when dispensed. Wood followers 38 have been found to work exceptionally well in this regard.

The roller 30, as best seen in FIG. 3B, has a plurality of metal projections or protrusions 58 disposed on its exterior surface, substantially as shown in FIG. 3B, for engaging with the material substrate of the napkins. The use of spaced-apart protrusions 58 for the purpose of penetrating and pulling out one napkin at a time has been found to be superior to other frictional means. As previously noted, in the preferred embodiment, the front wall 28 is angled with respect to the platform, providing additional space for the roller 30 and a more retrally placed surface of abutment 60 for the stack of napkins placed within the housing 16, as best seen in FIG. 3B; incidentally, this configuration allows the portion of the napkins above and below the roller 30 to slightly conform to the curvature of the roller 30, enabling a more effective frictional engagement therewith. It should be stressed that this structural configuration is for the preferred embodiment of the invention; however, alternative embodiments embrace any angle of placement of the front wall 28 with respect to the platform 18, from 0 to 180 degrees.

In addition to the dimensions previously described for the housing 16, it should be understood that this specification embraces all shapes, dimensions, and configurations for the housing 16, including symmetrical box-shaped designs, where all the housing walls, 26, 28, and 46, are perpendicular to the platform 18, or irregularly shaped designs for decorative purposes. For example, in a children's version of the dispenser 10, the housing 16, as well as any of the other parts of the invention, could embody shapes encompassing any design features or shapes and sizes.

The materials out of which the invention is preferably made should be mentioned. The walls, 26, 28, and 46, support platform 18, roller 30, roller pins 44, follower 38, and follower pins 54, are preferably made of wood; however in alternative embodiments of the dispenser 10, these parts may be made of any suitable material, including polymeric or plastic materials. The walls, 26, 28, and 46, platform 18, roller 30, roller pins 44, follower 38, and follower pins 54, may also be injection molded. In wooden embodiments of the dispenser 10, a surface coating of varnish or other suitable material may be added to improve the appearance of the invention and to decrease friction between the various wooden contacting parts of the invention such as between the follower pins 54 and the elongated follower groove 52 which the follower pins 54 use as a trackway The protrusions 58 are preferably made of steel, but may be made of any material sufficiently durable to provide the necessary penetrating effect. Moreover, the protrusions 58 may be set at any angle into the surface of the roller 30; alternatively, some protrusions 58 may be substantially perpendicular to the exterior surface of the roller 30, while other protrusions 58 may be embedded at an angle thereto, inclusive of 0 to 90 degrees with respect to the tangential plane where the central axis intersects the surface of the roller 30. This specification embraces all such angles of inclination or combinations thereof.

It should also be noted that this specification embraces any and all configurations for the protrusions 58, including those having barbed or pointed features or features for hooking, perforating, piercing, puncturing, and penetrating the material substrate of the napkins. In the preferred embodiment of the invention, the portion of the protrusions 58 extending above the surface of the roller are usually, but not inclusive, up to 0.1251" in length. Other lengths can be employed.

In the preferred embodiment, the protrusions 58 are substantially cylindrical in appearance, but, as noted, can be pointed or wedge-shaped as well. Furthermore, the protrusions 58 can be arranged in any pattern on the roller 30, including equally spaced-apart protrusions 58, protrusions 58 having a certain pattern such a geometric shape, or irregularly spaced patterns.

Conventionally available napkins typically have raised embossing which interferes with the smooth and easy removal of individual napkins from a stack, whether the napkins are placed in a napkin holder, dispenser, or arranged in a freestanding stack. Small metallic protrusions 58 overcome this problem by partially penetrating the cellulose fibers or material substrate of the napkin, allowing a single sheet of material to be selectively and precisely removed from the stack. Practical experimentation has shown that protrusions 58 work better than other elements for removing a particular napkin with respect to its particular stack.

In alternative embodiments of the invention, the napkin assembly comprising the roller 30 and follower 38 may be physically oriented so as to dispense the leading napkin of a stack of napkins in any particular direction; for example, napkins could be dispensed horizontally from the side of the apparatus through appropriately disposed slots. A valuable feature of this invention resides in the fact that, when the roller 30 is rotated, the stack of napkins is not pushed back or significantly compressed by the action of the roller 30, which can result in more than one napkin being displaced at a time; instead, the roller 30 acts to pick up and vertically displace each individual napkin, allowing the follower 38 to gently and incrementally slide down to maintain a constant pressure on the napkin stack.

Figure 5:
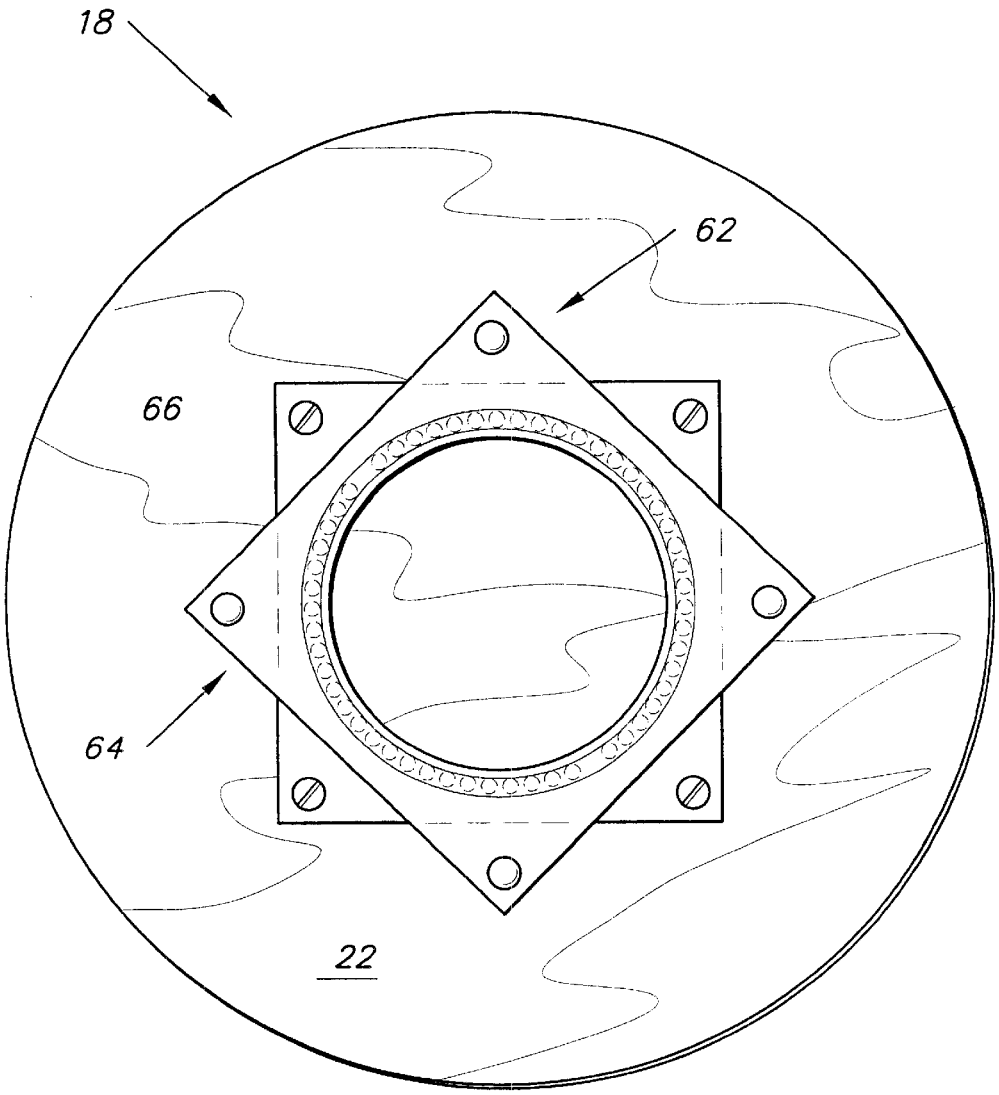
FIG. 5 is a bottom view of the napkin dispenser, according to the invention.

Referring now to FIG. 5, disposed on the bottom surface 22 of the support platform 18 is a rotatable bearing unit 62 which includes upper 64 and lower 66 bearing plates, each comprising a ring-shaped depression which, when matched together, define a raceway for bearing balls, a conventional structure which is well known in the art and which allows individuals sitting at table to leisurely take turns at the dispenser 10 without having to physically move or turn the dispenser 10 around. In alternative embodiments of the invention the rotatable bearing unit 62 may be absent.

Figure 6:
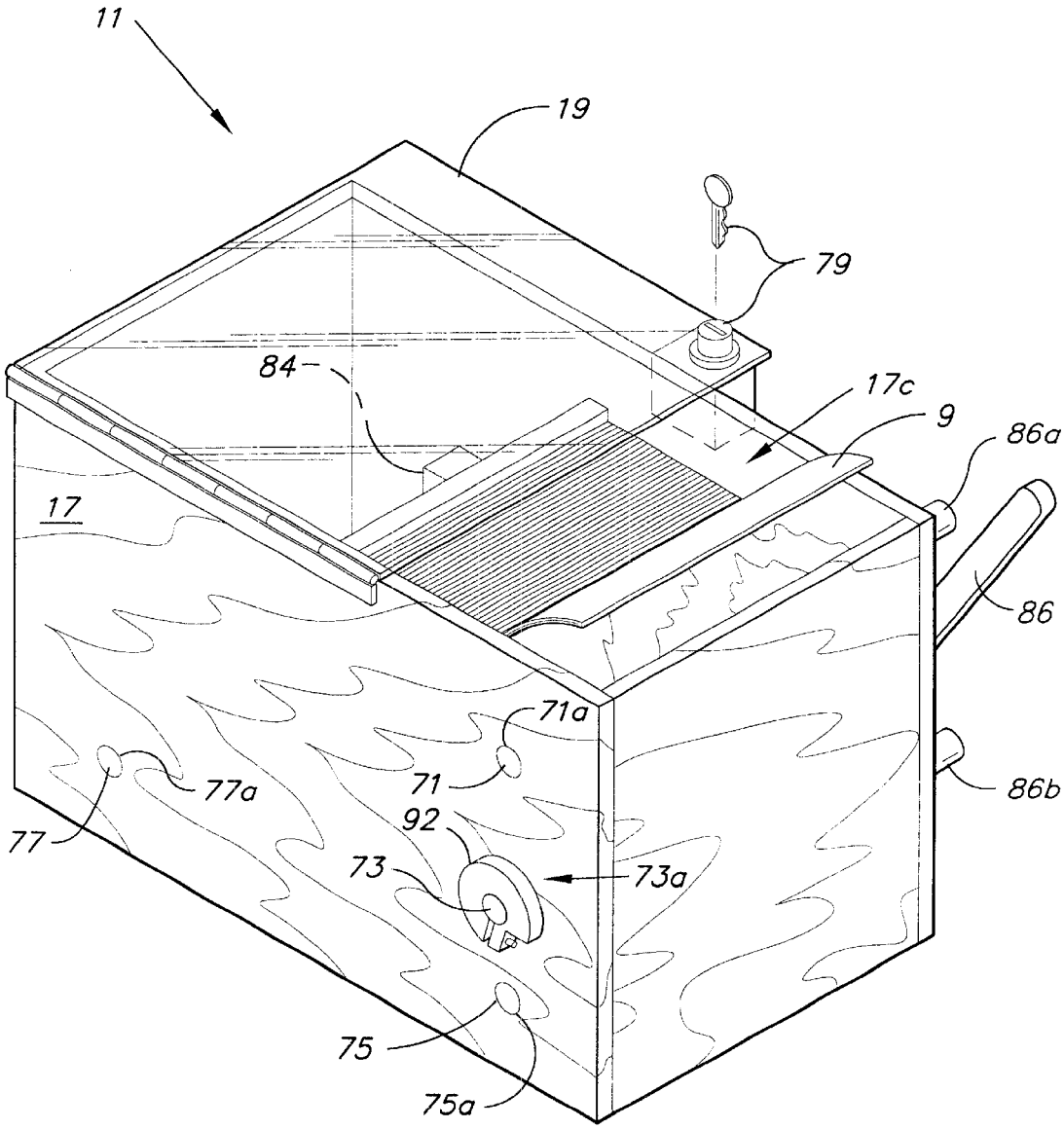
FIG. 6 is perspective view of the napkin dispenser according to a second embodiment.
Figure 7:
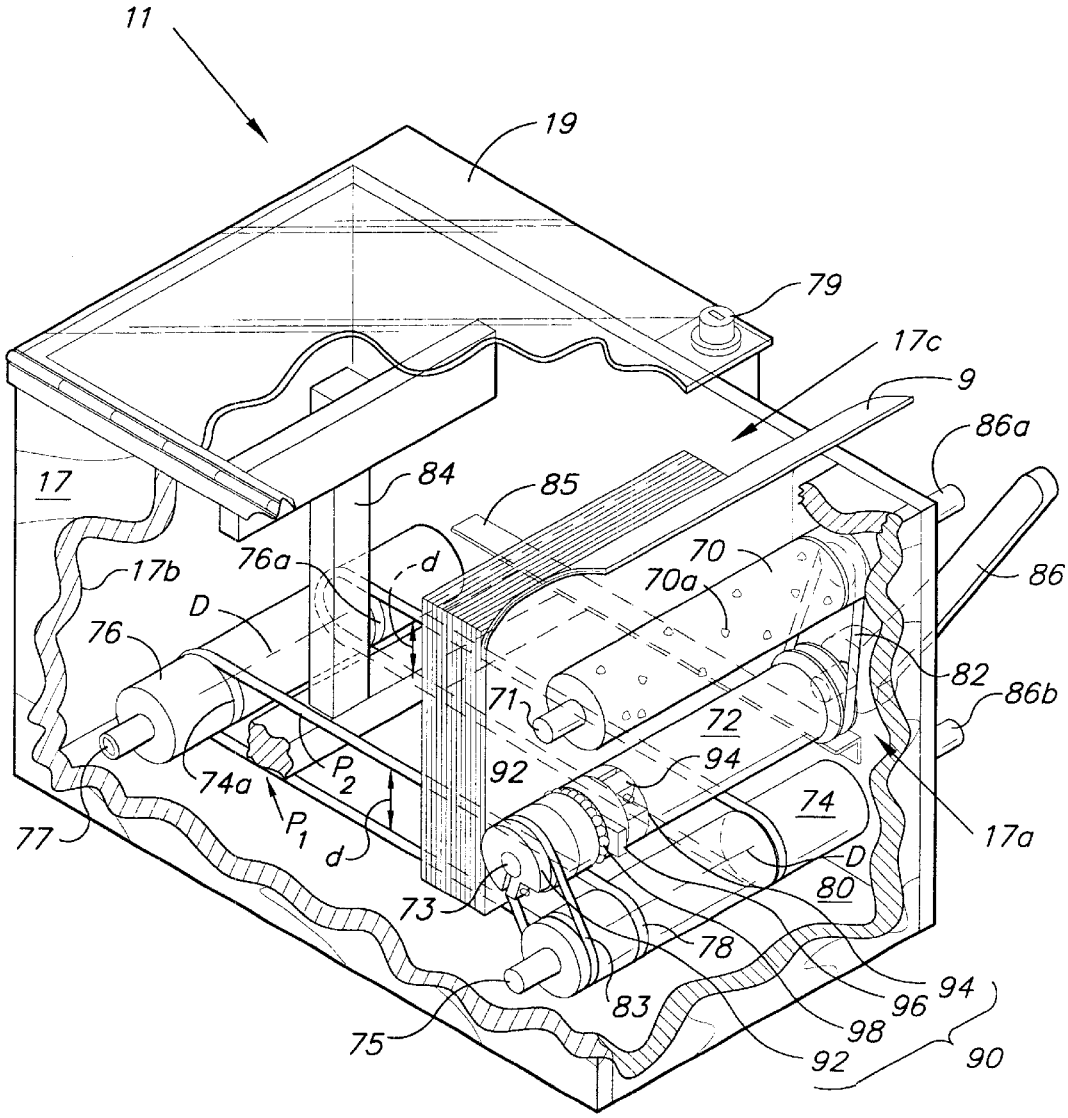
FIG. 7 is cut-away perspective view of FIG. 6, illustrating an internal protrusion mechanism according to the second embodiment.

As diagrammatically illustrated in FIGS. 6 and 7, the napkin dispenser according to the second embodiment 11 of the invention, shows a dispenser housing or enclosure 17 with a transparent hinged access door 19 for securing a stack of napkins therein. The dispenser 11 further comprises a key activated locking mechanism 79 to prevent unwanted removal of a over abundant supply of napkins. As diagrammatically illustrated in FIG. 7, the dispenser 11 comprising a plurality of rotatable dispenser elements 70, 72, 74 and 76 having respective rotating shaft elements 71, 73, 75 and 77 which when operative provide the effect of the assembly 36 according to the first or preferred embodiment. The operative effect of the dispenser 11 is realized when the dispenser elements 70, 72, 74 and 76 are interconnected via first and second conveyor belts 78 and 80, and first and second drive belts 82 and 84, respectively. This particular embodiment 11 is specially configured for commercial use in restaurants and the like which require an increased napkin supply or capacity as compared to the domestic use of the first embodiment 10. Each respective shaft member is fixedly and rotatably mounted within a respective first and second wall portion identified by locations (71*a*,71*b*), (73*a*,73*b*), (75*a*,75*b*) and (77*a*,77*b*). Also shown therein, are a plurality of conically shaped protrusions 70*a* peripherally disposed about the surface of the roller 70 and along its length for attaching to and transporting a single napkin in sequence.

The rotation motion of the assembly of elements 70, 72, 74 and 76 is enabled whereby, the first drive belt 82 dynamically couples the napkin feed roller 70 with the napkin guide roller 72; and the napkin guide roller 72 in turn is dynamically coupled to the feed advance drive roller 74 via the second drive belt 83. The advance drive roller 74 is in turn interconnected to the driven roller 76 via first and second conveyor belts 78 and 80, respectively. The belts are substantially centrally disposed on both rollers 74 and 76 via recessed grooves 74*a* and 76*a* as dynamic mechanical couplings having respective predetermined dynamic gap distances D therebetween, and predetermined gap distance d which provides frictional support and enables the traversal of the napkin stack support and feed bar 84 therebetween. A stack support guide rail 85 is mounted at opposing interior wall portions 17*a* and 17*b* of the housing 17 for slidably retaining or constraining the stack support and feed arm 84 therebetween.

Thus, a single lever arm 86 is fixedly and rotatably mounted to a central end portion 88 of the napkin guide roller 72 for dispensing a single napkin when the lever has traversed a path from a first handle stop 86*a* and a second handle stop 86*b*. The napkin stack support and feed bar 84 as shown therein is generally an I-shaped structure with the top portion 84*a* being shaped in the form of a "T" to provide support for a top portion of the last napkin in the stack. When the lever 86 is traversed between stops 86*a* and 86*b* the feed bar is calibrated to traverses a distance via selective and respective conveyor belt attachment points $P_1$ and $P_2$, equivalent to the thickness of a single napkin. Accordingly, each napkin is dispensed from the housing aperture 17*c* of predetermined dimensions. The visual depiction of the aperture 17*c* is only for illustrative purposes, and shoud not be miscontrueed to limit or restrict operative features. A calibration mechanism 90 which enables the dispensing of a single napkin is integrally disposed concentric with the napkin guide roller 72.

The mechanism 90 comprising an anti-backup brake collar 92, a napkin feed advance stop adjuster 94, a feed advance turn arm 96, and a feed advance return arm spring 98 having a predetermined stiffness k (N/m). The calibration of the mechanism 90 is determined based on a given napkin thickness per unit distance of the stretch-length of a the spring arm 98. In other embodiments the housing may also comprise at least one storage compartment for various objects, such as toothpicks, knives, forks, and spoons. In one alternative embodiment, the housing could comprise a generally rectangular shape having dispenser assemblies 36 at opposite ends, a central storage unit or portion for condiments, and a plurality of smaller storage units or portions for knives, forks, and spoons, each portion being preferably separated by appropriately disposed walls and located adjacent to the central storage unit; in this embodiment, the invention could be used as a barbecue caddy and might also have lifting handles.

And so it should be understood that this specification embraces embodiments of the dispenser 10 having more than one dispenser assembly 36, and more than one storage unit. Additionally embraced are embodiments comprising any number of depressions, apertures, or adjunct support elements or devices for holding condiments or condiment containers, as well as any variation of the embodiments thus far disclosed with or without the rotating means herein described. Napkins of any size and shape may be used in the dispenser.

Figure 8:
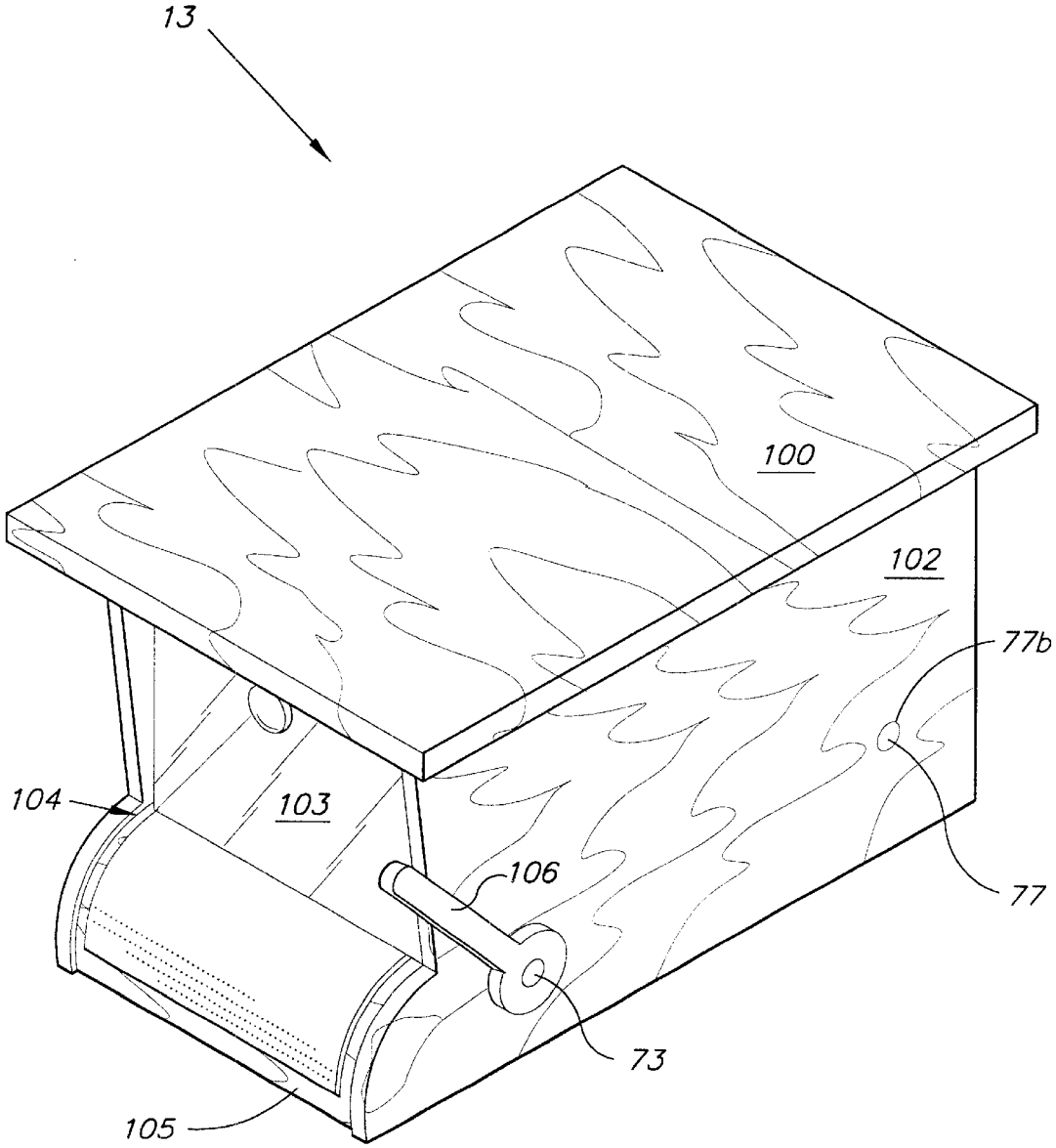
FIG. 8 is perspective view of the napkin dispenser according to a third embodiment, illustrating a dispenser configured for mounting under a counter.

As diagrammatically illustrated in FIG. 8, a napkin dispenser according to a third embodiment 13 of the invention is shown for mounting under counters via the top panel portion 100 via mechanical fasteners or the like (not shown). As shown therein this embodiment will work based on the same dispensing technique described for the second embodiment 11, except with a simple contour modification in the front of the napkin housing 102 via an napkin dispensing aperture 104, and wherein the transparent door panel 103 is a releasable (i.e. spring loaded mechanism, etc) hinged panel for quick access to the napking storage compartment within the interior portion of the housing 102. The contour modification as shown therein is arcuate in shape, and provides a napkin traversing surface 105 for retrieving each dispensed napkin. A lever arm 106 is similarly used in this embodiment 13 as depicted for embodiment 11, except there are no need for external stops. The stop points have been internally accounted for via the actual position of napkin feed advance stop adjuster 94 of the calibration mechanism 90.

One of the significant problems in the napkin dispensing industry is that many persons have considerable difficulty removing one napkin at a time from a stack of napkins in conventional devices. This problem or condition is worsened by common medical conditions such a arthritis or neuromuscular diseases suffered by the user. The present invention solves this problem by providing a napkin dispenser which can repeatedly deliver one napkin at a time without requiring the complex, delicate movements of the thumb and forefingers usually required to get a napkin. Instead, all that is required is for the user to turn the handle or roller pin 44 of the dispenser 10, thereby dispensing a single napkin, for easy retrieval. When the handle is pushed down to the stop element, one napkin will be lifted from the stack of napkins for easy removal.

In fact, even a partial turn of the roller will deliver a sufficient portion of the napkin. With one cycle of the handle, the stack support element will advance with the stack at a distance or alternatively thickness of a removed napkin. In alternative embodiments of the invention, a conventional motor may be provided to turn the roller 30, which may be activated by a conventional push button assembly, the combination of which is commonly known in the art. That is, the napkin feed roller houses two rows of protrusions (or pointed stainless steel pins) that pick and lift a single napkin for easy removal from the housing.

That is, the napkin feed roller is driven when the handle is pushed downward by means of a one direction bearing element, and is free to rotate when the napkin is manually pulled from the stack. Other features not discussed in detail include the use of bearing elements for the respective rotating shafts in the second embodiment. Since these features are considered to well within the knowledge of one having ordinary skill in the relevant art they have been excluded from further discussion. Notwithstanding, when the handle is pushed down and the arm of the handle is reset by means of the spring element, a new napkin is positioned in sequence for removal from the stack. Other advantages, include wherein the hinged cover is preferably a LEXAN or tranparant plastic cover.

It is to be understood that the present invention is not limited to the sole embodiments described above, but encompasses any and all embodiments within the scope of the following claims.

I claim:

1. A napkin dispensing device comprising:

(a) at least one napkin dispensing assembly, each said dispensing assembly having a roller and a follower, each said follower for urging a stack of napkins against a said corresponding roller of said napkin assembly; and (b) a napkin dispensing housing for housing said at least one napkin dispensing assembly therein, said housing having at least one wall having at least one inclined groove disposed therethrough.

2. The napkin dispensing device according to claim 1, wherein said at least one groove supports a said follower movably retained within said at least one groove, said follower for urging a stack of napkins against a said roller.

3. The napkin dispensing device according to claim 2, wherein said roller comprises a plurality of protrusions for sticking the leading napkin of a stack of napkins interposed between said follower and said roller, said roller for then displacing the leading napkin from its stack by movement of said roller.

4. The napkin dispensing device according to claim 3, wherein said roller has an exterior surface, said exterior surface having said protrusions disposed thereon, said protrusions each having a free end portion for penetrably engaging the material substrate of a leading napkin.

5. The napkin dispensing device according to claim 4, wherein said housing is fixedly attached to an underlying support platform, said platform having a top surface and a bottom surface.

6. The napkin dispensing device according to claim 5, wherein said platform bottom surface has a rotatable bearing unit disposed thereon.

7. The napkin dispensing device according to claim 6, wherein said housing may comprise at least one storage portion for storing eating utensils.

8. The napkin dispensing device according to claim 7, wherein said housing may comprise at least storage portion for storing condiments.

9. The napkin dispensing device according to claim 8, wherein said platform may have at least one condiment bottle support depression formed on said top surface for placement of the bottom portion of at least one condiment container thereon.

10. The napkin dispensing device according to claim 9, wherein said platform may comprise a rigid planar support element normally disposed thereon for holding articles between said support element and said housing.

11. The napkin dispensing device according to claim 10, further comprising at least one condiment container for removable placement on said at least one condiment bottle support depressions.

12. A napkin dispensing device comprising:

(a) at least one napkin dispensing assembly;

(b) a napkin dispensing housing for housing said at least one napkin dispensing assembly therein; and (c) a calibration mechanism for calibrating the traversal of said at least one napkin dispensing for traversing an equivalent distance equal to a thickness of a single napkin.

13. The napkin dispensing device according to claim 12, wherein said at least one napkin dispensing assembly each comprises a roller and a follower, each said follower for urging a stack of napkins against a said corresponding roller of said napkin assembly.

14. The napkin dispensing device according to claim 13, wherein said housing comprises at least one wall.

15. The napkin dispensing device according to claim 14, wherein said at least one wall comprises at least one inclined groove disposed therethrough.

16. The napkin dispensing device according to claim 15, wherein said at least one groove supports a said follower movably retained within said at least one groove, said follower for urging a stack of napkins against a said roller.

17. The napkin dispensing device according to claim 16, wherein said roller comprises a plurality of protrusions for sticking the leading napkin of a stack of napkins interposed between said follower and said roller, said roller for then displacing the leading napkin from its stack by movement of said roller.

* * * * *